United States Patent [19]

Bertolini

[11] Patent Number: 4,658,529

[45] Date of Patent: Apr. 21, 1987

[54] FIRING PIN SAFETY MECHANISM

[76] Inventor: William Bertolini, P.O. Box 113, R.D. 4, Montague, N.J. 07827

[21] Appl. No.: 641,123

[22] Filed: Aug. 15, 1984

[51] Int. Cl.[4] ..... F41C 11/02

[52] U.S. Cl. ..... 42/70.08

[58] Field of Search ..... 42/70 F, 70.08

[56] References Cited

U.S. PATENT DOCUMENTS

| | | | |
|---|---|---|---|
| 3,601,918 | 8/1971 | Keppeler | 42/70 F |
| 3,750,319 | 8/1973 | Roy | 42/70 F |
| 3,750,531 | 8/1973 | Angell et al. | 89/148 |
| 3,838,533 | 10/1974 | Ruger | 42/70 F |
| 4,316,340 | 2/1982 | Kahn | 42/70 X |
| 4,352,317 | 10/1982 | Wilhelm | 42/70 X |
| 4,454,673 | 6/1984 | Meidel | 42/70 |

*Primary Examiner*—Peter A. Nelson

*Attorney, Agent, or Firm*—Seidel, Gonda, Goldhammer & Abbott

[57] ABSTRACT

A firing pin safety mechanism for a weapon such as a pistol. An inertia firing pin is provided with an annular groove. The firing pin is spring loaded in the firing pin channel of the pistol slide. The safety is provided with a rib canted toward the hammer side of the firing pin. The safety is slidable between "on" and "off" positions within a safety channel which intersects the firing pin channel. When the safety is moved to the "on" position, the rib enters the firing pin groove and cams the firing pin so as to retract and lock the pin in a sheathed position within the slide. In the sheathed position, the firing pin can neither contact the cartridge nor be contacted by the weapon hammer. When the safety is moved to the "off" position, the rib clears the firing pin, and the hammer end of the firing pin is exposed. The firing pin is then free to be operated by the weapon hammer to strike the cartridge.

17 Claims, 6 Drawing Figures

FIRING PIN SAFETY MECHANISM

BACKGROUND OF THE INVENTION

The present invention is directed to a safety mechanism for an inertia firing pin for any caliber automatic weapon, for example a pistol such as the Colt Arm 45. In such pistols, the firing pin is maintained in a ready position, wherein the hammer end of the firing pin is exposed, by a spring which encompasses the pin in the pistol slide. The spring pressure prevents the cartridge end of the firing pin from protruding past the face of the pistol slide unless it is struck by the pistol hammer in normal fashion and/or the muzzle receives a sharp blow. The firing pin then moves forward in the slide to strike the cartridge and ignite the cartridge primer.

Automatic pistols of this kind are equipped with several safeties, all of which prevent movement of the pistol hammer. These safeties do not, however, secure the firing pin from moving forward to strike the cartridge if the pistol hammer is inadvertently operated and/or the pistol is inadvertently dropped on its muzzle. If the pistol is dropped on its muzzle, the inertial effect may allow the mass of the firing pin to overcome its retention spring, allowing the tip of the firing pin to contact the cartridge and cause ignition.

The present invention provides a safety mechanism for the firing pin which prevents movement of the firing pin even if the pistol is accidently dropped on its muzzle.

SUMMARY OF THE INVENTION

A firing pin safety mechanism includes a safety which is provided with a rib canted toward the hammer side of the firing pin. The firing pin is provided with a groove adapted to receive the rib. The safety is displaceable in a safety channel which is bored in the weapon slide transversely of the firing pin channel. A springloaded ball which is seated in the safety cooperates with detents formed in the slide to secure the safety in the "on" or "off" position. Movement of the safety to the "on" position locks the firing pin in a sheathed position by a camming action. In the sheathed position, the pin cannot be contacted by the weapon hammer and cannot advance toward the cartridge. Movement of the safety to the "off" position frees the pin, allowing the pin to be operated by the weapon hammer in the conventional manner.

DETAILED DESCRIPTION OF THE INVENTION

Figure 1:
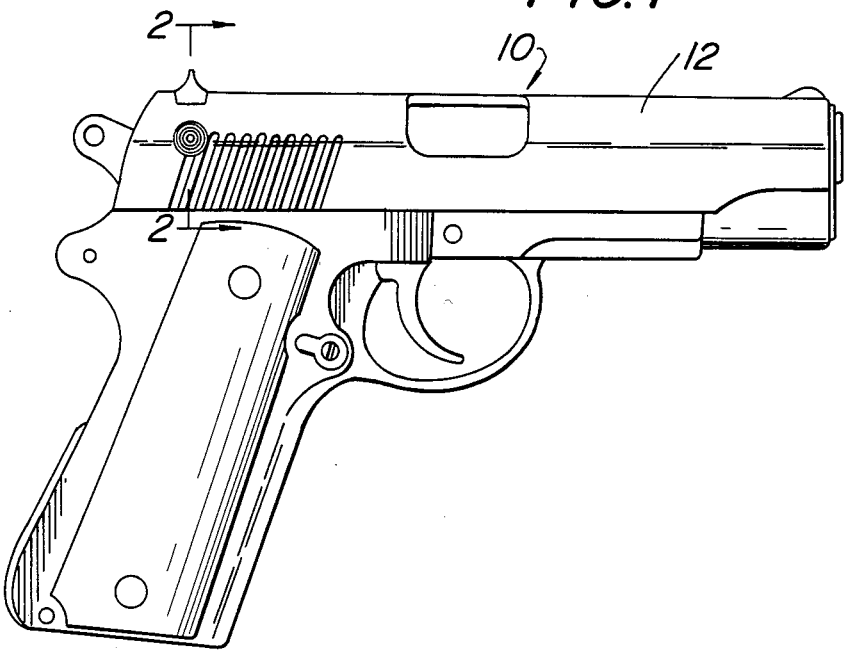
FIG. 1 is a side elevation of an automatic pistol showing the location of the safety mechanism of the present invention.

Referring to the drawings, wherein like numerals indicate like elements, there is shown in FIG. 1 an automatic pistol 10 comprising a slide 12 which houses the safety 14 and firing pin 16 of the present invention. The structure of the pistol 10 is generally conventional other than modification of the slide and firing pin and the addition of the safety as described hereafter.

Figure 2:
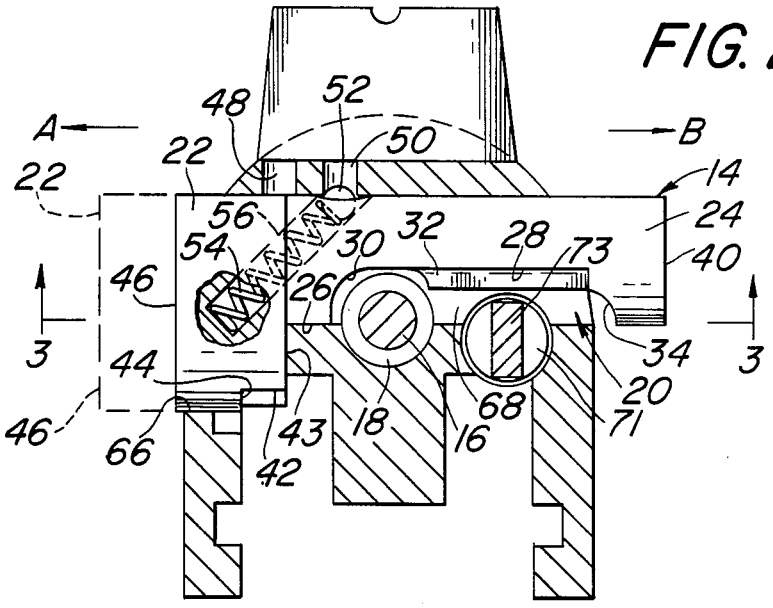
FIG. 2 is a cross-section taken along 2—2 in FIG. 1 showing the pistol slide, firing pin channel, safety channel, and spring-loaded ball and detent arrangement.
Figure 3:
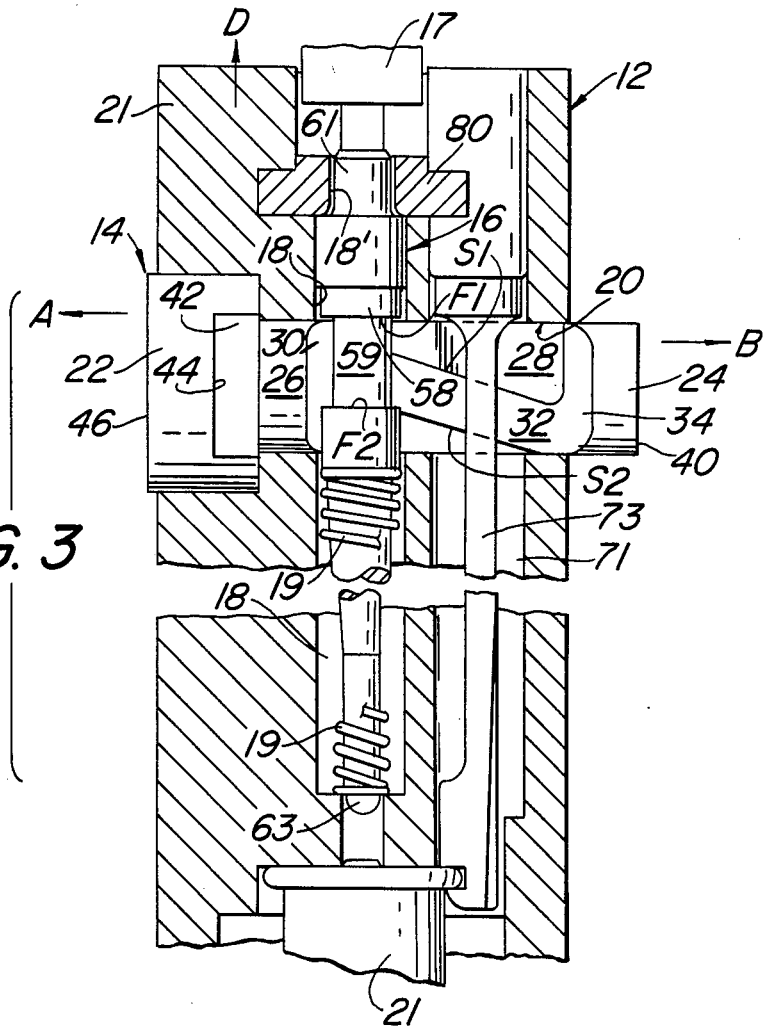
FIG. 3 is a section taken along 3—3 in FIG. 2 showing the safety rib and the firing pin groove, the safety being in the "off" position.
Figure 4:
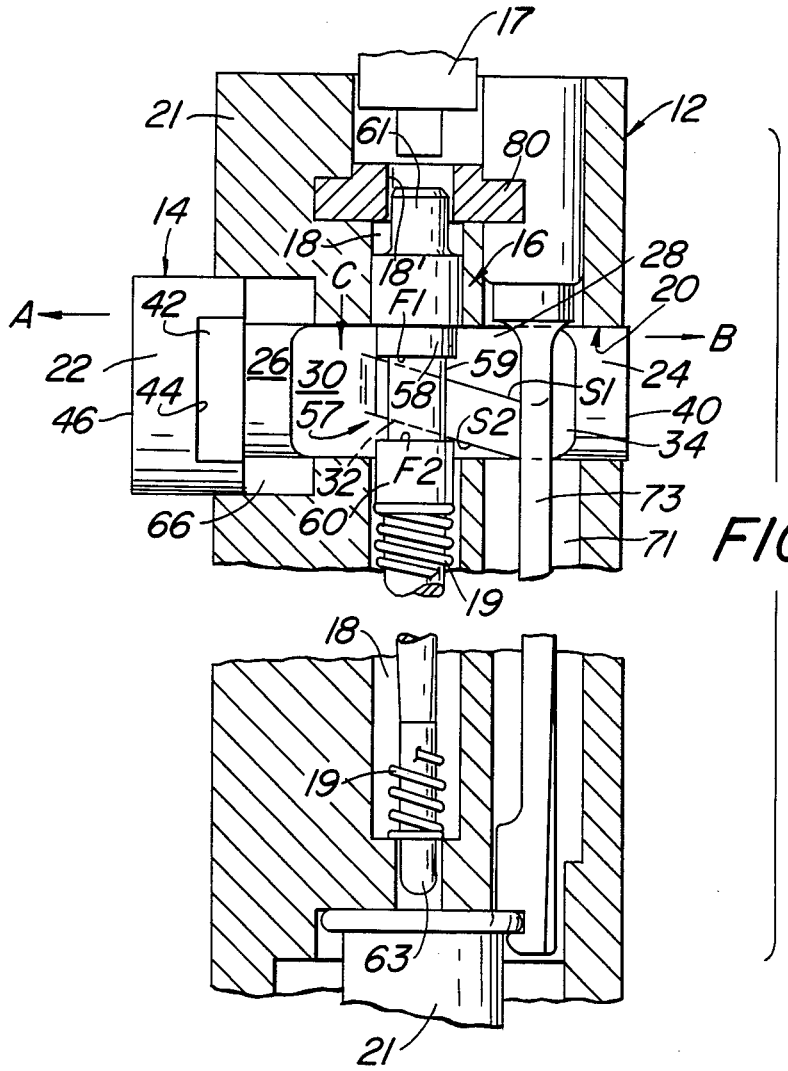
FIG. 4 is a section taken along 3—3 in FIG. 2 showing the safety and firing pin, the safety being in the "on" position.

The safety 14 and firing pin 16 of the present invention are best shown in FIGS. 2–4. Firing pin 16 is spring-urged to the ready position (FIG. 3) by a firing pin spring 19. A stop 80 which is slideably inserted in the slide limits movement of the firing pin in the direction of hammer 17. When in the ready position, the hammer end 61 of the firing pin is exposed and the firing pin can be operated by the hammer. The pin 16 and spring 19 are housed in the firing pin channel 18 which is located in the slide. The stop 80 is provided with an opening 18' which serves as an extension of the firing pin channel. The stop accomodates the hammer end of the firing pin while preventing the firing pin from exiting the rear of the firing pin channel. The length of the firing pin is less than the length of the firing pin channel so that the firing pin can be sheathed in the channel as described hereafter. A safety channel 20 is counterbored in the slide and extends across the slide so as to intersect the firing pin channel. Safety 14 is slideably housed in the safety channel. Preferably, the longitudinal axis of the safety channel is normal to the longitudinal axis of the firing pin channel.

Safety 14 is a unitary structure comprising cylindrical portions 22 and 24 of different diameters. Cylindrical portions 22, 24 are eccentrically disposed with respect to each other i.e., the longitudinal axis of cylindrical portion 24 is spaced in elevation from the longitudinal axis of cylinder 22. The top surfaces of cylindrical portions 22, 24 meet at a common tangent line as shown in FIG. 2. The bottom of cylindrical portion 24 is cut-out as shown in FIGS. 3 and 4 to provide a cylindrical portion 26 and a planar surface or land 28. Portion 26 and land 28 are separated by a curved or concave surface 30 having a radius sufficiently large to provide clearance for firing pin 16 as described hereafter. The bottom of cylindrical portion 24 is also cut-out to form a rib 32 projecting from land 28. When the safety is installed in the slide, the rib is canted towards the hammer side of the firing pin. See FIGS. 3 and 4. The rib extends from a curved or concave stop surface 34. The free end 40 of cylindrical portion 24 is scribed or otherwise roughened to prevent the user's thumb from slipping when transferring the safety to the "on" position as described hereafter.

The cylindrical portion 22 of safety 14 is also cutout at its bottom so as to provide a flat 42 which leads to a partial face or wall 44. See FIG. 2. Cylindrical portion 22 is cut-out in this manner so as not to obstruct movement of the slide on the weapon when the safety is in the "off" position. The free end 46 of cylindrical portion 22 is also scribed or otherwise roughened to prevent the user's thumb from slipping when transferring the safety to the "off" position as described hereafter.

The top portion of slide 12 is provided with a pair of openings 48, 50 which serve as detents for a spring-loaded ball 52. See FIGS. 2 and 5. Ball 52 is loaded at the end of a spring 54 which is seated in an angled bore 56 formed in the safety 14. Ball 52 lodges in detent 48 or detent 50 to releasably lock safety 14 in the "on" or "off" positions as described hereafter.

Figure 5:
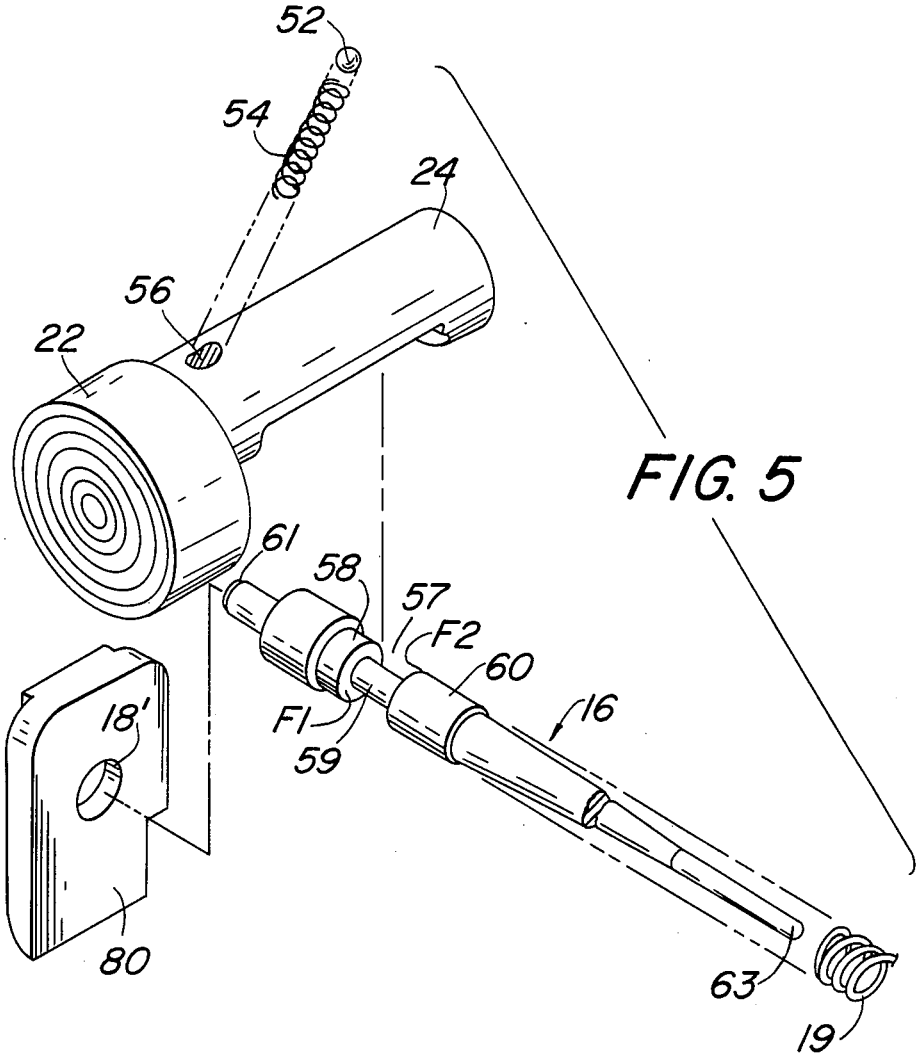
FIG. 5 is an exploded perspective of the safety, firing pin and firing pin stop.
Figure 6:
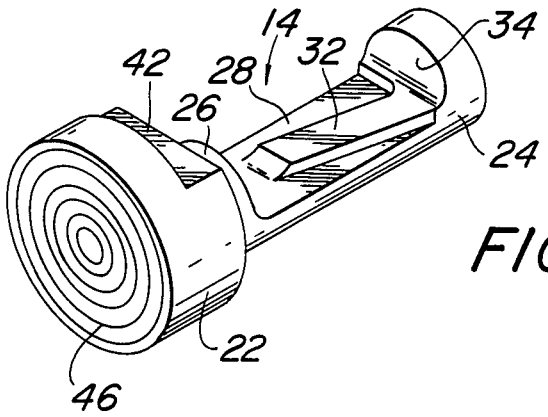
FIG. 6 is an enlarged perspective of the safety.

Referring to FIGS. 3–5, the firing pin 16 is a unitary structure which is cut-away to define an annular groove 57 surrounding a shaft 59 which connects cylindrical portions 58 and 60. The hammer end 61 of the firing pin is proximal cylinder 58. The cartridge end 63 of the firing pin is located at the tapered end of the firing pin. Safety rib 32 travels across groove 57 as described hereafter when safety 14 is transferred between the "on" and "off" positions.

The shape of safety channel 20 is best shown in FIG. 2. Channel 20 includes eccentric counterbored cylindrical passages 66 and 68. Passage 66 houses portion 22 of the safety, and passage 68 houses portion 24. Passage 68 intersects the firing pin channel 18 as well as an extractor channel 71 within which extractor 73 is located. The extractor prevents safety 14 from sliding out of the safety channel, in the direction of arrow A in FIG. 2, by obstructing safety stop surface 34. The face 43 of cylinder 22 contacts the slide to prevent the safety from falling out of the safety channel in the direction of arrow B in FIG. 2.

When the safety is in the "off" position, as shown in FIGS. 2 (solid lines) and 3, rib 32 clears the annular groove between firing pin cylindrical portions 58 and 60. The safety is disposed such that concave surface 30 partially surrounds firing pin 16 and provides clearance for movement of the firing pin in channel 18. Spring 56 urges ball 52 into the mouth of detent 50 so that the ball lodges therein to releasably lock safety 14 in position.

To transfer the safety to the "on" position, the user places his finger against the scribed end 40 of the safety and pushes the safety into the slide in the direction of arrow A so as to overcome the pressure of spring 54. During transfer of the safety to the "on" position, as shown in FIGS. 2 (phantom) and 3–4, rib 32 rides across annular groove 57 atop shaft 59. Side S2 of rib 32 contacts face F2 of cylinder 60 as the rib enters groove 57. See FIG. 3. The rib cams firing pin 16 in the direction of arrow C (FIG. 4) such that hammer end 61 is recessed within stop 80. Cartridge end 63 moves in the direction of arrow C as well, but remains in channel 18. When the safety reaches the "on" position, side S1 of rib 32 contacts face F1 of cylindrical portion 58. Further movement of the firing pin is therefor blocked by the safety, and further movement of the safety is prevented by ball 52 which lodges in the mouth of detent 48 (FIG. 2). The firing pin is locked in position, with hammer end 61 and cartridge end 63 being sheathed within the slide. Should hammer 17 be inadvertently operated so dropped causing slide 12 and firing pin 16 to move together towards the hammer, the hammer will strike stop 80. The stop prevents the firing pin from being contacted by the hammer. Thus, the firing pin is locked in position with respect to the slide so that hammer end 61 cannot be contacted by the hammer and cartridge end 63 cannot contact the cartridge.

To transfer the safety to the "off" position, the user places his finger against the scribed end 46 of the safety and pushes the safety into the slide in the direction of arrow B. The safety slides within channel 20 in the direction of arrow B so as to cammingly release the firing pin. The firing pin moves under spring pressure in the direction of arrow D (FIG. 3) so that the hammer end 61 of the pin protrudes past stop 80 where it can be struck by the hammer. Cartridge end 63 remains sheathed in the slide but is now free to move out of the slide into contact with the cartridge under force of the hammer. The safety is locked in the "off" position by ball 52 which lodges in the mouth of detent 50. The concave surface 30 of the safety is aligned with the longitudinal axis of the firing pin so as to provide clearance for movement of the firing pin toward cartridge 21 under force of the hammer.

Any automatic pistol of the type described can be simply and conveniently retrofitted to incorporate the safety mechanism of the present invention. To do so, it is only necessary to counterbore safety channel 20 in the pistol slide, mill the slide to provide detents 48, 50, mill firing pin 16 to form groove 57, install safety 14 (with spring-loaded ball 52) in channel 20 in the "off" position, insert extractor 73 in channel 71 to secure the safety in position, insert the spring-loaded firing pin in channel 18, and insert stop 80 in the slide to secure the firing pin in position. The safety 14 and firing pin 16 are unitary structures, as previously indicated, thereby facilitating assembly of the invention as well as repair and replacement of each part.

I claim:

1. Firing pin safety mechanism for a weapon provided with a slide having a firing pin channel, comprising:

a firing pin mounted for sliding movement between a "ready" position wherein at least one end of the firing pin extends outside said firing pin channel and a "sheathed" position wherein both ends of said firing pin are disposed within the firing pin channel, said firing pin being yieldingly loaded to said "ready" position, a safety channel in the weapon slide extending transversely of the firing pin channel and intersecting the firing pin channel, a safety mounted in said safety channel for sliding movement between "on" and "off" positions, said safety and firing pin being provided with cam means for cammingly moving said firing pin to and locking said firing pin in the "sheathed" position when said safety is moved to the "on" position and for cammingly releasing said firing pin for movement to said "ready" position when said safety is moved to the "off" position.

2. Firing pin safety mechanism according to claim 1 wherein said cam means includes a groove in said firing pin and a rib on said safety.

3. Firing pin mechanism according to claim 2 wherein said rib is disposed so as to contact at least two surfaces of said firing pin when said safety is in the "on" position.

4. Firing pin safety mechanism according to claim 1 including means for releasably locking said safety in said "on" and "off" positions.

5. Firing pin mechanism according to claim 4 wherein said releasable locking means includes a pair of detents in said slide and a ball yieldingly loaded in said safety.

6. Firing pin safety mechanism for a weapon provided with a slide having a firing pin channel, comprising:

a firing pin mounted for sliding movement between a "ready" position wherein at least one end of the firing pin extends outside said firng pin channel and a "sheathed" position wherein both ends of said firing pin are disposed within the firing pin channel, said firing pin being yieldingly loaded to said "ready" position, a safety channel in the weapon slide extending transversely of the firing pin channel and intersecting the firing pin channel, and including eccentric counterbored passages in said slide, a safety mounted in said safety channel for sliding movement between "on" and "off" positions and comprising eccentric cylindrical portions, said safety and firing pin being provided with cam means for cammingly moving said firing pin to and locking said firing pin in the "sheathed" position when said safety is moved to the "on" position and for cammingly releasing said firing pin for movement to said "ready" position when said safety is moved to the "off" position.

7. Firing pin safety mechanism according to claim 1 wherein said safety is a unitary structure.

8. Firing pin safety mechanism for a weapon provided with a slide having a firing pin channel, comprising:

a firing pin mounted for sliding movement between a "ready" position wherein at least one end of the firing pin extends outside said firing pin channel and a "sheathed" position wherein both ends of said firing pin are disposed within the firing pin channel, said firing pin being yieldingly loaded to said "ready" position, a safety channel in the weapon slide extending transversely of the firing pin channel and intersecting the firing pin channel, a safety mounted in said safety channel for sliding movement between "on" and "off" positions, said firing pin being provided with a groove and said safety being provided with a rib, said groove and rib cooperating such that said rib enters said groove and cammingly moves said firing pin to and locks said firing pin in the "sheathed" position when said safety is moved to the "on" position and such that said rib cammingly releases said firing pin for movement to said "ready" position when said safety is moved to the "off" position.

9. Firing pin safety according to claim 8 wherein said rib is disposed so as to contact at least two surfaces of said firing pin when said safety is in the "on" position.

10. Firing pin safety mechanism according to claim 8 including means for releasably locking said safety in said "on" and "off" positions.

11. Firing pin safety mechanism according to claim 10 wherein said releasable locking means includes a pair of detents in said slide and a ball yieldingly loaded in said safety.

12. Firing pin safety mechanism according to claim 8 wherein said safety channel comprises eccentric counterbored passages in said slide and wherein said safety comprises eccentric cylindrical portions.

13. Safety for a firing pin safety mechanism, comprising:

a pair of eccentricically disposed cylindrical portions, one of said cylindrical portions being cut-away so as to form a rib and a space between said rib and the other cylindrical portion, said rib being canted with respect to the longitudinal axis of said cut-away cylindrical portion.

14. Safety according to claim 13 wherein the surfaces of said cylindrical portions meet at a common tangent line.

15. Safety according to claim 13 wherein said safety is a unitary structure.

16. Firing pin for a firing pin safety mechanism, comprising:

a pair of cylindrical portions separated by an annular groove, a shaft connecting said cylindrical portions, an end portion disposed on one side of one of said cylindrical portions and adapted to be struck by a hammer, another end portion disposed on one side of the other cylindrical portion and adapted to strike a cartridge so as to ignite the cartridge primer.

17. Firing pin according to claim 16 wherein said firing pin is a unitary structure.

* * * * *